US009756688B2

(12) United States Patent
Chen

(10) Patent No.: US 9,756,688 B2
(45) Date of Patent: *Sep. 5, 2017

(54) HIGH EFFICIENCY LED DRIVERS WITH HIGH POWER FACTOR

(71) Applicant: Silergy Semiconductor Technology (Hangzhou) LTD, Hangzhou, ZheJiang Province (CN)

(72) Inventor: Wei Chen, Saratoga, CA (US)

(73) Assignee: Silergy Semiconductor Technology (Hangzhou) LTD, Hangzhou (CN)

( * ) Notice: Subject to any disclaimer, the term of this patent is extended or adjusted under 35 U.S.C. 154(b) by 63 days.

This patent is subject to a terminal disclaimer.

(21) Appl. No.: 14/742,868

(22) Filed: Jun. 18, 2015

(65) Prior Publication Data

US 2015/0289332 A1 Oct. 8, 2015

Related U.S. Application Data

(63) Continuation of application No. 13/855,883, filed on Apr. 3, 2013, now Pat. No. 9,107,270.

(30) Foreign Application Priority Data

May 22, 2012 (CN) ..... 2012 1 0163203

(51) Int. Cl.
*H05B 33/08* (2006.01)
*H05B 37/02* (2006.01)

(52) U.S. Cl.
CPC ..... *H05B 33/0815* (2013.01); *H05B 33/0848* (2013.01); *H05B 33/0887* (2013.01); *H05B 33/0842* (2013.01); *H05B 37/02* (2013.01)

(58) Field of Classification Search
None
See application file for complete search history.

(56) References Cited

U.S. PATENT DOCUMENTS

| | | | | |
|---|---|---|---|---|
| 9,107,270 | B2 * | 8/2015 | Chen | H05B 33/0887 |
| 2002/0171467 | A1 * | 11/2002 | Worley, Sr. | H05B 33/0815 327/514 |
| 2004/0095108 | A1 * | 5/2004 | Kernahan | H03K 19/0963 323/282 |
| 2005/0225259 | A1 * | 10/2005 | Green | H02M 3/1588 315/224 |
| 2008/0224636 | A1 | 9/2008 | Melanson | |

(Continued)

*Primary Examiner* — Douglas W Owens
*Assistant Examiner* — Srinivas Sathiraju
(74) *Attorney, Agent, or Firm* — Michael C. Stephens, Jr.

(57) ABSTRACT

The present invention relates to a high efficiency, high power factor LED driver for driving an LED device. In one embodiment, an LED driver can include: an LED current detection circuit coupled to the LED device, and configured to generate a feedback signal that represents an error between a driving current and an expected driving current of the LED device; a power stage circuit, where a first power switch terminal is coupled to a first input voltage, and a second power switch terminal is coupled to ground; and a control circuit configured to generate a control signal according to the feedback signal and a drain-source voltage of the power switch, where the control signal, in each switch period, turns on the power switch when the drain-source voltage reaches a low level, and turns off the power switch after a fixed time interval based on the feedback signal.

17 Claims, 9 Drawing Sheets

(56) References Cited

U.S. PATENT DOCUMENTS

2010/0117545 A1* 5/2010 Kelly ..... H02M 1/4225 315/152
2010/0277088 A1* 11/2010 Bodano ..... H05B 33/0818 315/283
2011/0025225 A1 2/2011 Horiuchi et al.
2011/0101880 A1* 5/2011 Ribarich ..... H05B 33/0815 315/250
2011/0204823 A1 8/2011 Mizukawa et al.
2011/0285301 A1 11/2011 Kuang et al.
2011/0285685 A1 11/2011 Naito et al.
2012/0081039 A1* 4/2012 Yang ..... H05B 33/0815 315/307
2012/0181943 A1* 7/2012 Monney ..... H05B 37/0227 315/210
2012/0217888 A1* 8/2012 Chang ..... H05B 33/0848 315/200 R
2012/0262961 A1 10/2012 Chien et al.
2013/0002159 A1* 1/2013 Chen ..... H05B 33/0848 315/200 R
2013/0020945 A1 1/2013 Kuang et al.
2013/0020955 A1 1/2013 Igaki et al.
2013/0083578 A1 4/2013 Kotowski et al.
2013/0181626 A1 7/2013 Chen
2013/0268745 A1* 10/2013 Uehata ..... G06F 9/4416 713/2
2013/0300315 A1 11/2013 Lee et al.
2013/0313989 A1* 11/2013 Chen ..... H05B 33/0887 315/200 R
2014/0009080 A1 1/2014 Xu
2014/0111108 A1 4/2014 Qu et al.
2014/0159598 A1 6/2014 Boezen
2014/0203716 A1 7/2014 Tao
2014/0210353 A1 7/2014 Chen
2014/0246985 A1 9/2014 Chen
2014/0265899 A1 9/2014 Sadwick
2014/0347345 A1 11/2014 Yoshizawa
2014/0361702 A1 12/2014 Chen

* cited by examiner

HIGH EFFICIENCY LED DRIVERS WITH HIGH POWER FACTOR

RELATED APPLICATIONS

This application is a continuation of the following application, U.S. patent application Ser. No. 13/855,883, filed on Apr. 3, 2013, and which is hereby incorporated by reference as if it is set forth in full in this specification, and which also claims the benefit of Chinese Patent Application No. 201210163203.3, filed on May 22, 2012, which is incorporated herein by reference in its entirety.

FIELD OF THE INVENTION

The present invention relates to the field of electronic technology, and more specifically to light-emitting diode (LED) drivers and associated methods.

BACKGROUND

With continuous innovation and rapid development in the lighting industry, and growing importance of energy conservation and environmental concerns, light-emitting diode (LED) lighting is developing rapidly as a revolutionary energy-saving lighting technology. The brightness of an LED lamp is related to light output intensity that is not only determined by an LED's current and forward voltage drop, but also can vary with the temperature. Therefore, LED lamps should be driven by substantially constant current sources to ensure stability of LED lamp outputs, and to achieve ideal luminous intensity. As such, it is important to utilize appropriate LED drivers for LED lamps. Without a suitable LED driver, many advantages of LED lighting may not be realized.

SUMMARY

Particular embodiments can provide precharge circuits and methods for a high efficiency, high power factor light-emitting diode (LED) driver with precise sampling relatively simple driving circuitry for power switches.

In one embodiment, an LED driver configured to drive an LED device, can include: (i) a rectifier bridge configured to receive an AC input voltage source, and to provide a first input voltage and a second input voltage; (ii) an LED current detection circuit coupled to the LED device, where the LED current detection is configured to generate a feedback signal that represents an error between a driving current and an expected driving current of the LED device; (iii) a power stage circuit having a power switch, where a first power switch terminal is coupled to the first input voltage, and a second power switch terminal is coupled to ground; and (iv) a control circuit coupled to the LED current detection circuit and the power stage circuit, where the control circuit is configured to generate a control signal according to the feedback signal and a drain-source voltage of the power switch, where the control signal is configured, in each switch period, to turn on the power switch when the drain-source voltage reaches a low level, and to turn off the power switch after a fixed time interval based on the feedback signal.

Embodiments of the present invention can advantageously provide several advantages over conventional approaches. For example, by setting different peripheral circuits according to relationships between input and output voltages, buck topology driving and boost-buck driving circuitry can be suitable in a variety of applications. Also, because a power switch and control circuitry may be common-ground, a direct driving method can be used to drive the power switch to reduce circuit volume and overall product costs. In addition, driving and power losses can be decreased due to relatively soft switching. Also, an LED driving current feedback signal can be directly received by the control circuit to improve regulating accuracy of the LED current, and the average input current can also follow a sinusoidal input voltage source to obtain a relatively higher power factor. In addition, power supplies for components of the control circuit can be obtained from the power stage circuit directly, so complex magnetic components (e.g., transformers or inductors with multiple winding, power switches and other devices) may not be needed, thus reducing overall product costs and power losses. Other advantages of the present invention may become readily apparent from the detailed description of preferred embodiments below.

DETAILED DESCRIPTION

Reference may now be made in detail to particular embodiments of the invention, examples of which are illustrated in the accompanying drawings. While the invention may be described in conjunction with the preferred embodiments, it may be understood that they are not intended to limit the invention to these embodiments. On the contrary, the invention is intended to cover alternatives, modifications and equivalents that may be included within the spirit and scope of the invention as defined by the appended claims. Furthermore, in the following detailed description of the present invention, numerous specific details are set fourth in order to provide a thorough understanding of the present invention. However, it may be readily apparent to one skilled in the art that the present invention may be practiced without these specific details. In other instances, well-known methods, procedures, processes, components, structures, and circuits have not been described in detail so as not to unnecessarily obscure aspects of the present invention.

Light-emitting diode (LED) drivers may be configured by boost converters. However, drivers with buck topology can also match well with many loop control structures, and may not be necessary to consider the limit of the stability. Also, hysteresis control may be suitable for applications requiring relatively fast transform of switching frequency, and relatively small input range, which can meet requirements of LED drivers. However, buck converters may not be widely applied to various applications, due to certain limitations thereof.

Figure 1:
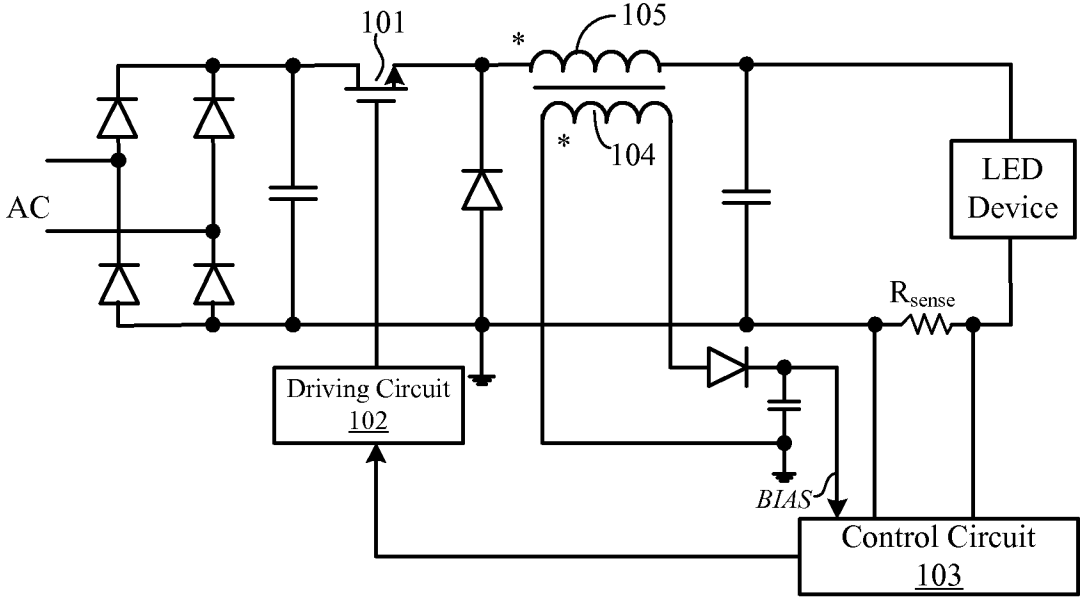
FIG. 1 shows a block diagram of a first example buck LED driver.

With reference to FIG. 1, shown is an example LED driver with buck topology, which can include a power stage circuit, a control circuit, and a driving circuit. In this example, in order to provide power supply to control circuit 103, additional auxiliary winding 104 can be coupled to inductor 105 of the power stage circuit to receive power. Thus, the inductor size may be too large to satisfy common demands of product miniaturization. In addition, because power switch 101 and control circuit 103 in the power stage circuit may not be at the same potential, driving circuit 102 for power switch 101 may need to employ "float" driving technology, which may increase the circuit complexity and overall product cost. In addition, float driving technology may cause relatively power losses, as compared to those utilizing a direct driving method.

Figure 2:
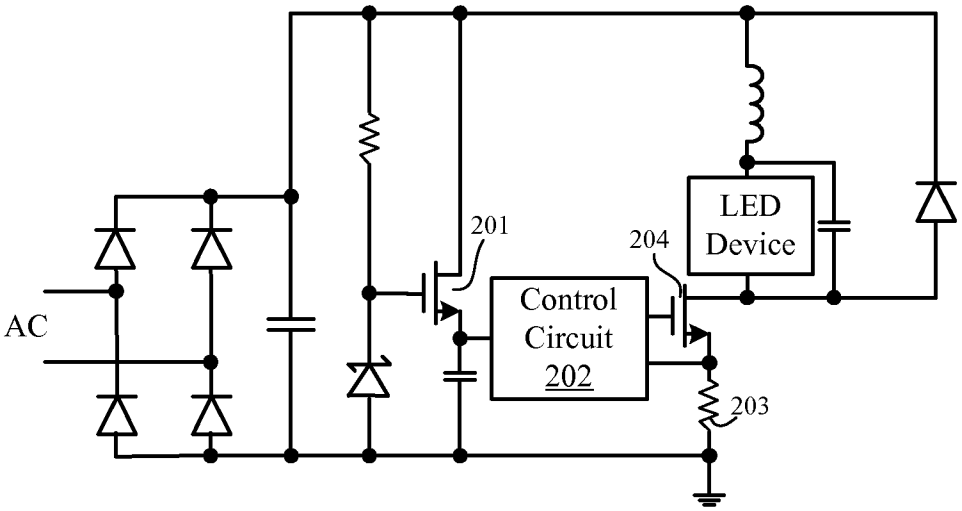
FIG. 2 shows a block diagram of a second example buck LED driver.

FIG. 2 shows another example LED driver with buck topology that is different from the LED driver shown in FIG. 1. In FIG. 2, a separate linear buck switch 201 can be applied to supply power for the control circuit. However, with such a power supply method, power losses on a linear zener diode may vary with an AC input power. For example, when an input voltage is relatively high, power losses on a linear zener diode can also be too high to be neglected, and may result in relatively low power conversion efficiency of the drive circuit. Also, as sampling resistor 203 may only sample an output inductor current when the power switch is on, control circuit 202 may be unable to directly receive an LED current signal. As such, the regulating accuracy of the LED current may decrease. Particularly in applications with a relatively large input voltage range and/or a relatively large output inductor variation range, the regulating accuracy of the LED current may worsen.

Embodiments of the present invention can advantageously provide several advantages over conventional approaches. For example, by setting different peripheral circuits according to relationships between input and output voltages, buck topology driving and boost-buck driving circuitry can be suitable in a variety of applications. Also, because a power switch and control circuitry may be common-ground, a direct driving method can be used to drive the power switch to reduce circuit volume and overall product costs. In addition, driving and power losses can be decreased due to relatively soft switching. Also, an LED driving current feedback signal can be directly received by the control circuit to improve regulating accuracy of the LED current, and the average input current can also follow a sinusoidal input voltage source to obtain a relatively higher power factor. In addition, power supplies for components of the control circuit can be obtained from the power stage circuit directly, so complex magnetic components (e.g., transformers or inductors with multiple winding, power switches and other devices) may not be needed, thus reducing overall product costs and power losses.

In one embodiment, an LED driver configured to drive an LED device, can include: (i) a rectifier bridge configured to receive an AC input voltage source, and to provide a first input voltage and a second input voltage; (ii) an LED current detection circuit coupled to the LED device, where the LED current detection is configured to generate a feedback signal that represents an error between a driving current and an expected driving current of the LED device; (iii) a power stage circuit having a power switch, where a first power switch terminal is coupled to the first input voltage, and a second power switch terminal is coupled to ground; and (iv) a control circuit coupled to the LED current detection circuit and the power stage circuit, where the control circuit is configured to generate a control signal according to the feedback signal and a drain-source voltage of the power switch, where the control signal is configured, in each switch period, to turn on the power switch when the drain-source voltage reaches a low level, and to turn off the power switch after a fixed time interval based on the feedback signal.

Figure 3A:
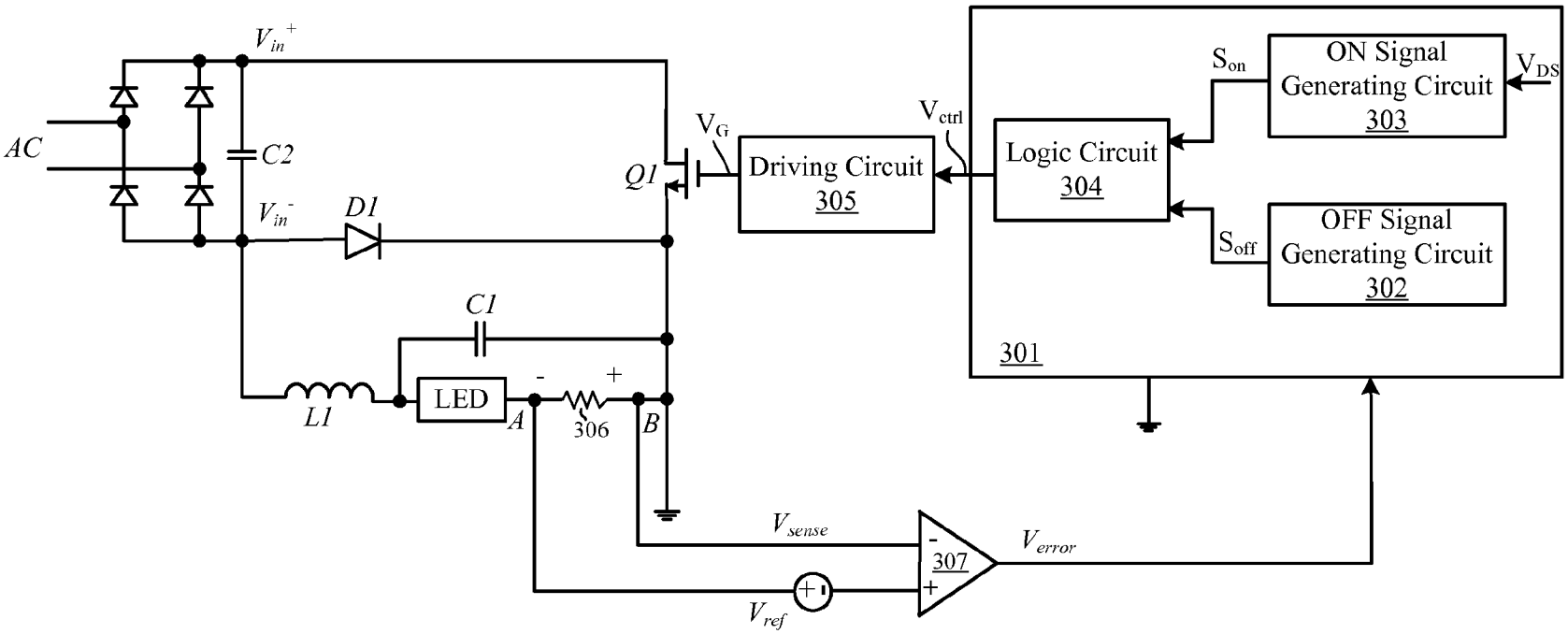
FIG. 3A shows a block diagram of an example LED driver in accordance with embodiments of the present invention.

Referring now to FIG. 3A, shown is a block diagram of an example LED driver in accordance with embodiments of the present invention. In this example, a sine wave AC input power supply can be converted into a half sine wave DC input voltage through a rectifier bridge and filter capacitor C2. For example, the DC input voltage may have a first input level $V_{in}^{+}$, and a second input level $V_{in}^{-}$. For example, in a buck topology power stage circuit, power switch Q1, output diode D1, output inductor L1, and output capacitor C1 can form the buck topology power stage circuit. In some applications, however, output capacitor C1 may not be necessary.

In this particular example, an N-type power MOSFET can be utilized as power switch Q1. A drain of power switch Q1 can connect to first input level $V_{in}^{+}$, and a source can connect to ground. Output diode D1 can be configured between second input level $V_{in}^{-}$ and the source of power switch Q1. Output inductor L1 can be configured between an LED device and second input level $V_{in}^{-}$. Output capacitor C1 can be configured between a common connection node of the LED device and output inductor L1, and the source of power switch Q1, to minimize the AC current component on the LED device.

An LED current detector in this example LED driver can include detection resistor 306 and error amplifier 307. One end of detection resistor 306 can connect to the LED device with a common connection node A, and the other end can connect to the source of power switch Q1 with a common connection node B. An inverting input terminal of error amplifier 307 can connect to the common connection node B, while a non-inverting input terminal can connect to the common connection node A through voltage reference source $V_{ref}$, which can represent an expected driving current of the LED device. Since detection resistor 306 is directly connected to the LED device, relatively accurate driving current information $V_{sense}$ of the LED device can be obtained. Errors between driving current information $V_{sense}$ and reference voltage $V_{ref}$ can be amplified by error amplifier 307, to obtain feedback signal $V_{error}$, which can represent error information between the given driving current and the expected driving current.

Control circuit 301 can include OFF signal generating circuit 302, ON signal generating circuit 303, and logic circuit 304. For example, ON signal generating circuit 303 can receive a drain-source voltage $V_{DS}$ of power switch Q1. When the drain-source voltage $V_{DS}$ reaches to a low level (e.g., a lowest voltage level in a given cycle), ON signal $S_{on}$ can be generated. Also, OFF signal generating circuit 302 can receive feedback signal $V_{error}$ to generate OFF signal $S_{off}$ with a fixed time interval. For example, the "fixed" time interval can be determined based on feedback signal $V_{error}$. As such, the fixed time interval may be different per cycle if feedback signal $V_{error}$ renders different values. However, in other cases the fixed time interval may be substantially the same from one cycle to the next. Further, logic circuit 304 can receive ON signal $S_{on}$ and OFF signal $S_{off}$ to generate control signal $V_{ctrl}$. For example, $V_{ctrl}$ can go high on a rising edge of $S_{on}$, and $V_{ctrl}$ can be reset to low on a rising edge of $S_{off}$.

Figure 3B:
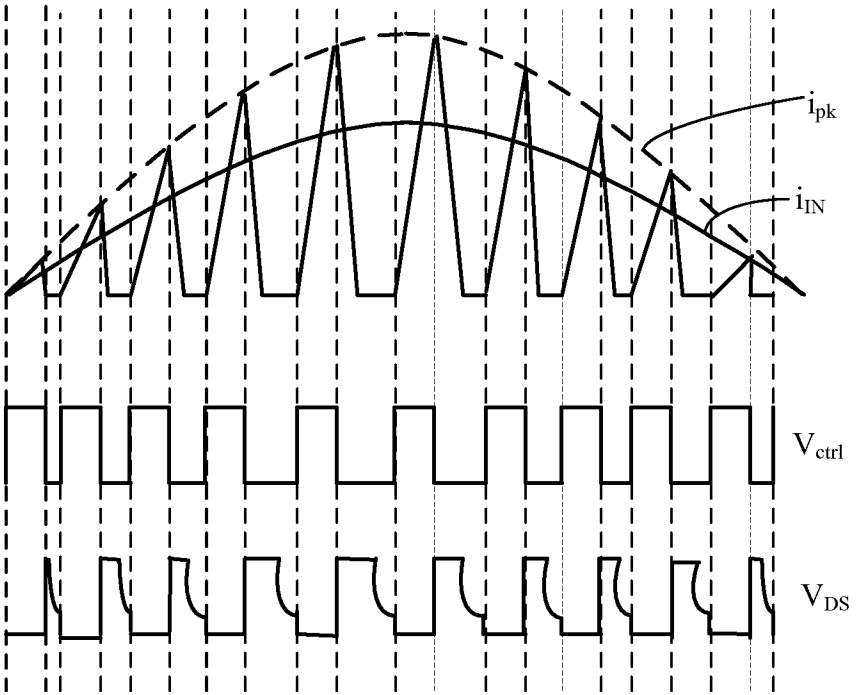
FIG. 3B shows an example waveform diagram of the LED driver shown in FIG. 3A.

Driving circuit 305 can receive control signal $V_{ctrl}$ to generate driving signal $V_G$ for power switch Q1. Here, the source of power switch Q1 can connect to ground, and at the same potential as control circuit 301, so drive signal $V_G$ can directly drive power switches Q1. The following will describe example operation of the LED driver shown in FIG. 3A, in conjunction with the waveform diagram in FIG. 3B.

An LED driver in accordance with embodiments of the present invention shown in FIG. 3A may operate in a discontinuous current mode (DCM). In each switching period, during the off-time interval of power switch Q1 (including the time interval when inductor current $i_L$ is zero), inductor L1, a parasitic capacitance of power switch Q1, and a line impedance may resonate, so drain-source voltage $V_{DS}$ of power switch Q1 may appear as an attenuated sinusoidal waveform. By detecting drain-source voltage $V_{DS}$ through ON signal generating circuit 303, power switch Q1 can be controlled to turn on at the low level of drain-source voltage $V_{DS}$. In this way, "soft" switching of power switch Q1 can be achieved and the power losses can be largely reduced to a minimum value, or even zero in some cases.

Then, OFF signal generating circuit 302 can receive feedback signal $V_{error}$, and after a certain fixed time interval, can generate OFF signal $S_{off}$ to turn off power switch Q1. For example, a length of the fixed time interval mentioned above can be determined by feedback signal $V_{error}$. As such, the fixed time interval may be different from one cycle to the next in some cases based on the value of feedback signal $V_{error}$. In other cases, the fixed time interval may be substantially the same from one cycle to the next. Since feedback signal $V_{error}$ can characterize a difference between the present driving current and the expected driving current of the LED driver, by regulating the length of the fixed time interval through feedback signal $V_{error}$, an on time of power switch Q1 can be accordingly controlled, and a driving current of the LED driver can thereby be modulated to be consistent with the expected driving current.

Also, because feedback signal $V_{error}$ can be essentially unchanged in a half line cycle of half sine wave input voltage $V_{in}$, fixed time interval $t_{on}$ can also be maintained as substantially constant. From principles of a buck topology power stage circuit, the peak inductor current $i_{pk}$ can be expressed as below in Equation 1.

$$i_{pk} = \frac{V_{in} - V_{LED}}{L} \times t_{on} \tag{1}$$

Here, $V_{LED}$ can represent a driving voltage of the LED device (e.g., the output voltage of the LED driver), L can represent the inductor value of inductor L1, and $t_{on}$ can represent a length of on time of power switch Q1 in each switching cycle. As $V_{LED}$, inductor value L, and the length of on time $t_{on}$ can be substantially constant in the line cycle of half sine wave input voltage $V_{in}$, inductor current peak $i_{pk}$ can follow half sine wave input voltage $V_{in}$ with a sinusoidal shaped peak current envelope. Therefore, the average value of the inductor current (e.g., input current $i_{in}$) may be substantially in the same phase as half sine wave input voltage $V_{in}$. As a result, the LED driver shown in FIG. 3A can have a relatively high power factor.

Therefore, by applying the LED driver in FIG. 3A, current flowing through the LED device can be accurately detected by the LED current detection circuit, to further obtain error feedback signal $V_{error}$ precisely representing a difference between the present driving current and the expected drive current. In addition, the control circuit can regulate the on time length of power switch Q1 according to feedback signal $V_{error}$, to maintain the current of LED device as substantially constant, and to improve the control accuracy. In addition, high power factor can be obtained by power factor correction. Also, by directly driving power switch Q1, the circuit can be more stable with reduced product costs, circuit complexity, and power losses.

People skilled in the art will recognize that power switch transistor Q1 can be implemented using different types of switching devices (e.g., PMOS transistor, bipolar transistor, etc.). Also, the LED current detection circuit can be implemented as any other suitable detection circuit structures. In addition, output inductor L1 can be coupled between the LED device and a second power terminal of the power switch, and/or output capacitor C1 can be coupled in parallel to the output circuit, as alternative arrangements.

Figure 4:
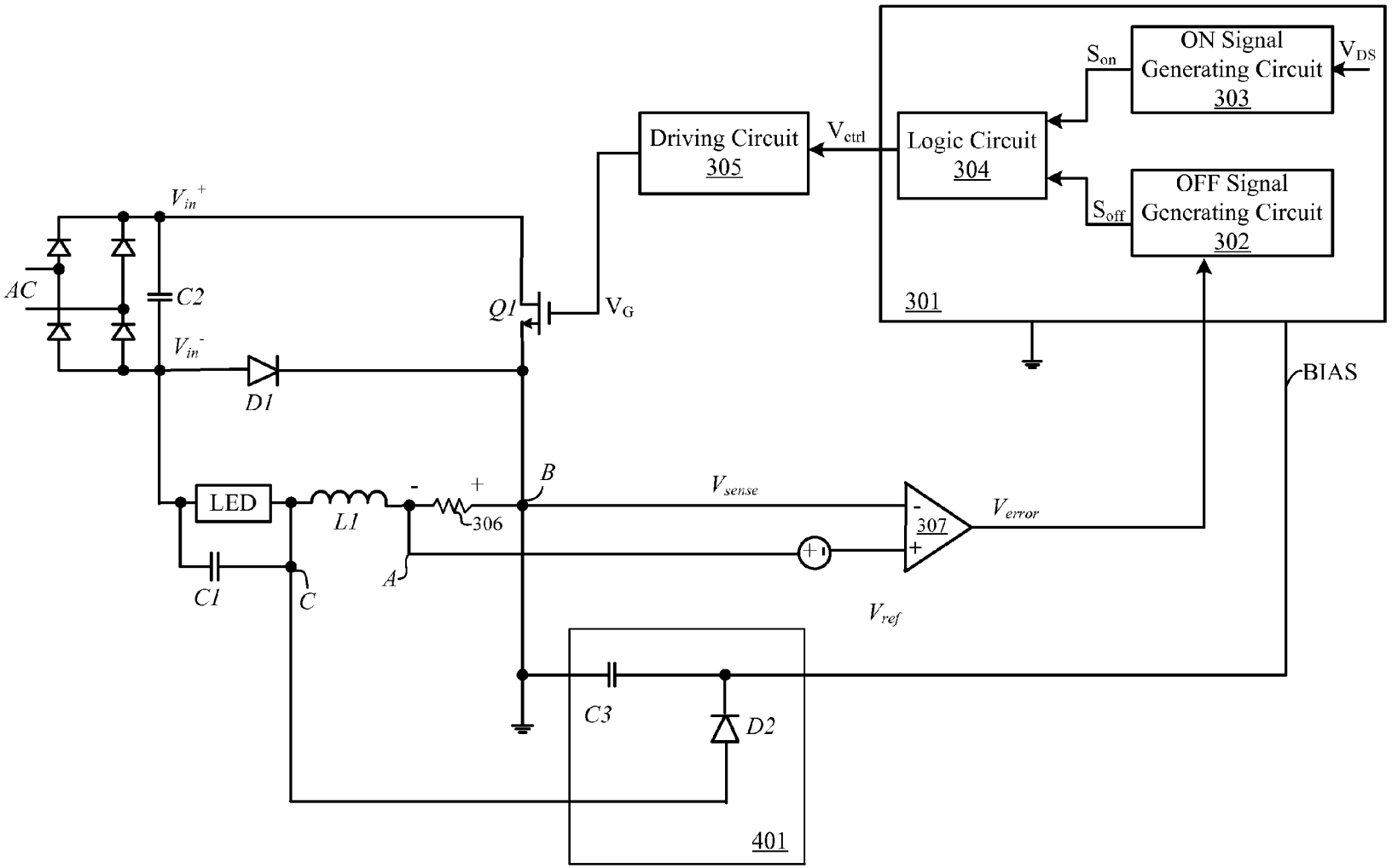
FIG. 4 shows a block diagram of an example buck LED driver with bias power supply in accordance with embodiments of the present invention.

Referring now to FIG. 4, shown is a block diagram of an example buck LED driver with bias power supply in accordance with embodiments of the present invention. In this example, the LED device, inductor L1, and detection resistor 306 may be sequentially coupled between second input level $V_{in}^-$ and the source of power switch transistor Q1. Output capacitor C1 and the LED device may be coupled in parallel. Based on the example buck LED driver in FIG. 3A, bias power supply circuit 401 is supplemented in this particular example.

Bias power supply circuit 401 can include diode D2 and capacitor C3. For example, one end of diode D2 can connect to a common connection node C of the LED device and output inductor L1, and the other end can connect to one end of capacitor C3, while the other end of capacitor C3 can connect to the source of power switch Q1. A voltage on the common connection node C of diode D2 and capacitor C3 can be configured as the bias power supply for control circuit 301. In some applications, output capacitor C1 can also be omitted.

By using the buck LED driver shown in FIG. 4, not only may accurate detection of LED current be achieved, but circuit control accuracy can be improved, driving of the power switch can be simplified, product costs and driving losses can be reduced, and a relatively higher power factor can be obtained, as compared to conventional approaches. Also, through a diode peak rectifier circuit configured by diode D2, the output voltage of the LED can be converted to a bias power supply of control circuit 301. By utilizing such a power supply approach, power losses and overall product cost can be reduced.

Of course, if the output voltage of the LED is too high, control circuit 301 may utilize a buck voltage regulator. Also, if the output voltage of the LED is too low, output inductor L1 may utilize an auxiliary winding to generate a bias power supply for the control circuit 301. Alternatively, a charge pump technique may be utilized to generate a higher voltage to operate as the bias power supply for control circuit 301. Because the maximum withstand voltage of power switch transistor Q1 may be an input peak voltage, and the peak current value of power switch transistor Q1 can equal the LED driving current, LED drivers with buck topology as shown in FIGS. 3A and 4 can reduce power losses and product costs to improve circuit regulating efficiency.

Figure 5A:
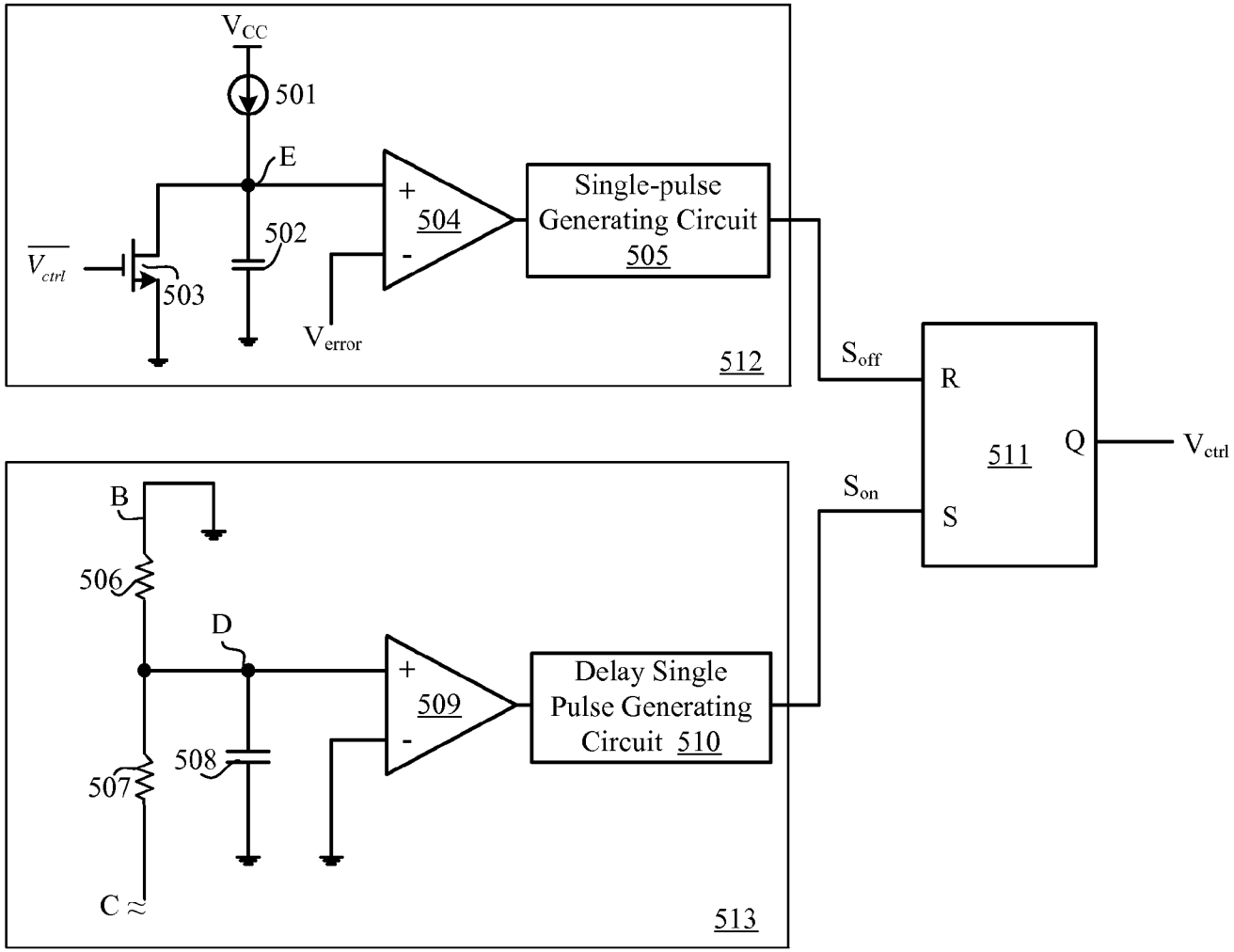
FIG. 5A shows a block diagram of an example buck LED driver with a composite power switch in accordance with embodiments of the present invention.
Figure 5B:
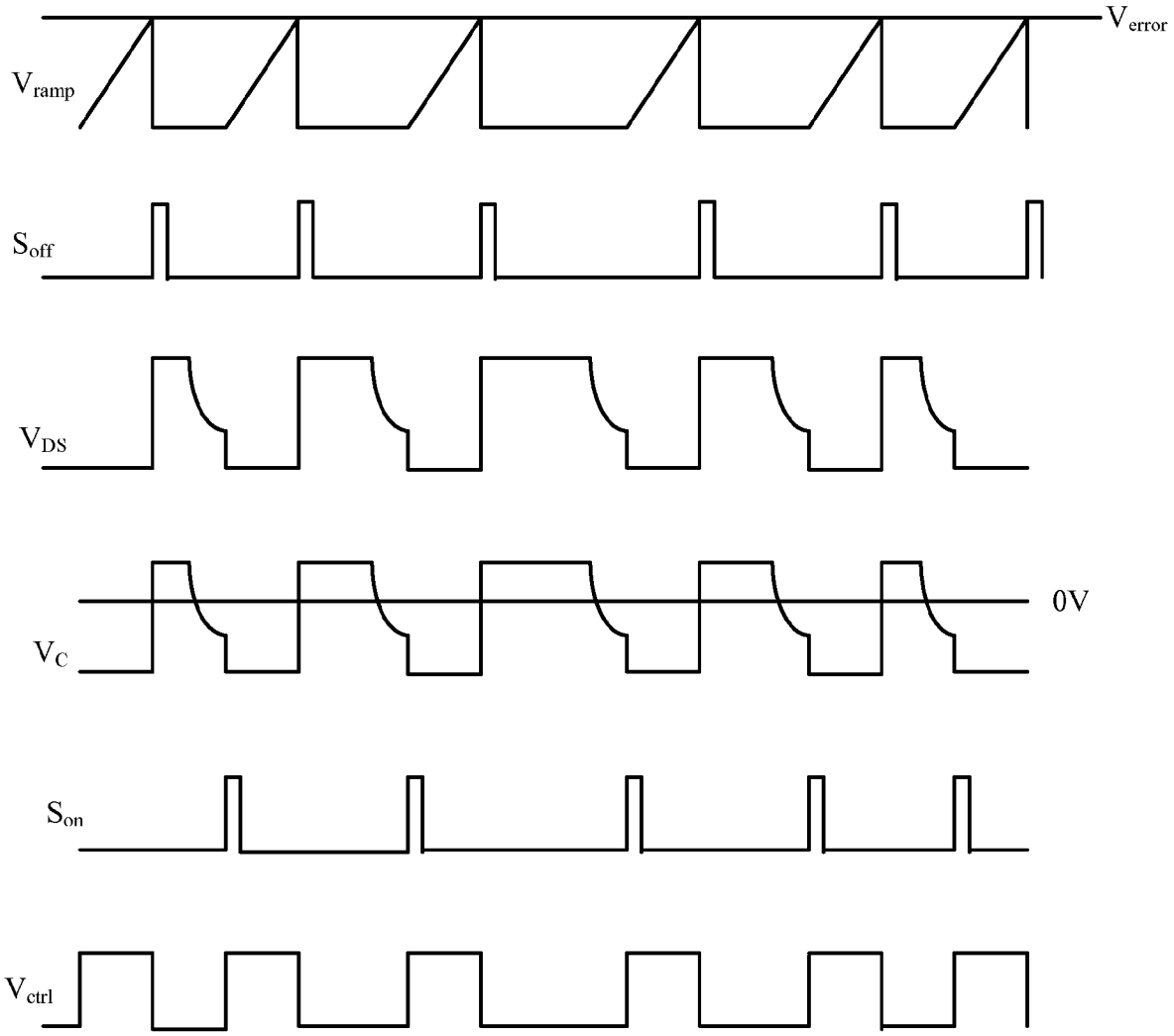
FIG. 5B shows an example waveform diagram of the control circuit of the LED driver in shown in FIG. 5A.

The following will describe an example control circuit implementation and method of the LED driver in accordance with embodiments of the present invention. Referring to now FIG. 5A, shown is a block diagram of an example control circuit of an LED driver in accordance with embodiments of the present invention. This particular example control circuit can include OFF signal generating circuit 512, ON signal generating circuit 513, and logic circuit 511. In conjunction with an example waveform diagram in FIG. 5B of the control circuit of the LED driver shown in FIG. 5A, a working principle of the LED driver circuit can be ascertained.

ON signal generating circuit 503 can be used to generate on signal $S_{on}$ when drain-source voltage $V_{DS}$ reaches a low level. On the basis of the LED driver shown in FIG. 4, ON signal generating circuit 513 can determine a time of the low level of the drain-source voltage by detecting a voltage between node B (e.g., a common connection node of power switch transistor Q1 and detection resistor 306) and node C (e.g., a common connection node of the LED device and inductor L1). In the off-time interval of the power switch, the voltage waveforms of voltage $V_c$ at node C and the drain-source voltage may be substantially the same. Therefore, the low level time can be determined by detecting voltage $V_C$.

Resistor 506 and resistor 507 can be connected in series between nodes B and C with a common connection node D, so that divided voltage $V_D$ can be obtained by dividing voltage $V_C$. Divided voltage $V_D$ can connect to a non-inverting input terminal of comparator 509, and may be filtered by capacitor 508 coupled between node D and ground. Also, an inverting input terminal of comparator 509 can connect to ground. When divided voltage $V_D$ is zero, the output signal of comparator 509 may transition to trigger delay single pulse generating circuit 510 so as to generate a single pulse signal at signal $S_{on}$. By setting the delay time of delay single pulse generating circuit 510, a low level time of voltage $V_C$ and the drain-source voltage of power switch can be determined. In this way, a quasi-resonant power switch of the power driver, and reduced switching losses, can be realized.

OFF signal generating circuit 512 can be used to generate off signal $S_{off}$ after a fixed time interval when power switch Q1 is on, based on the feedback signal $V_{error}$. In this example, during the on time interval of the power switch, off signal $S_{off}$ can be generated by comparing a rising ramp signal against the feedback signal. For example, a series connected current source 501 and capacitor 502 can be configured between voltage source $V_{CC}$ and ground. Switch 503 and capacitor 502 can be coupled in parallel between node E and ground, where switch 503 can be controlled by an inversion of control signal $V_{ctrl}$.

During the conduction time interval of power switch Q1, switch 503 may be off, and current source 501 can maintain charging of capacitor 502. Thus, ramp voltage $V_{ramp}$ at common connection node E can continue to rise, and at the non-inverting input terminal of comparator 504, while the inverting input terminal of comparator 504 can receive feedback signal $V_{error}$. After fixed time interval $t_{on}$, when the ramp voltage reaches a level of feedback signal $V_{error}$, the output of comparator 504 may transition to trigger single-pulse generating circuit 505 in order to generate a single pulse signal (e.g., off signal $S_{off}$). Since feedback signal $V_{error}$ may be substantially constant, and fixed time interval $t_{on}$ can remain substantially constant, the on time of the power switch may also remain substantially constant.

In this example, the logic circuit may be implemented as RS flip-flop 511, where a set terminal can connect to ON signal generating circuit 513 to receive on signal $S_{on}$, a reset terminal can connect to OFF signal generating circuit 512 to receive off signal $S_{off}$, and an output signal at output terminal Q can be used as control signal $V_{ctrl}$ to control a switching operation of the power switch. When on signal $S_{on}$ is active, power switch Q1 can be turned on by control signal $V_{ctrl}$ after driving circuit 305 (to generate $V_G$). After a fixed time interval, off signal $S_{off}$ may be activated, so power switch Q1 can be turned off by control signal $V_{ctrl}$. Therefore, by turning on and turning off the power switch periodically, the driving current of the LED driver can be adjusted to be consistent with the expected driving current, and the input current can be maintained in a same phase as the sine wave input voltage.

Those skilled in the art will recognize that the ON signal generating circuit and the OFF signal generating circuit can be implemented as any other kind of suitable circuit structures. For example, the detection voltage of the ON signal generating circuit can be the drain-source voltage of the power switch directly, or other signals that more indirectly characterize such a drain-source voltage can be utilized. Also, other suitable detection methods for detecting the time of the drain-source voltage low level can also be utilized in particular embodiments.

Figure 6:
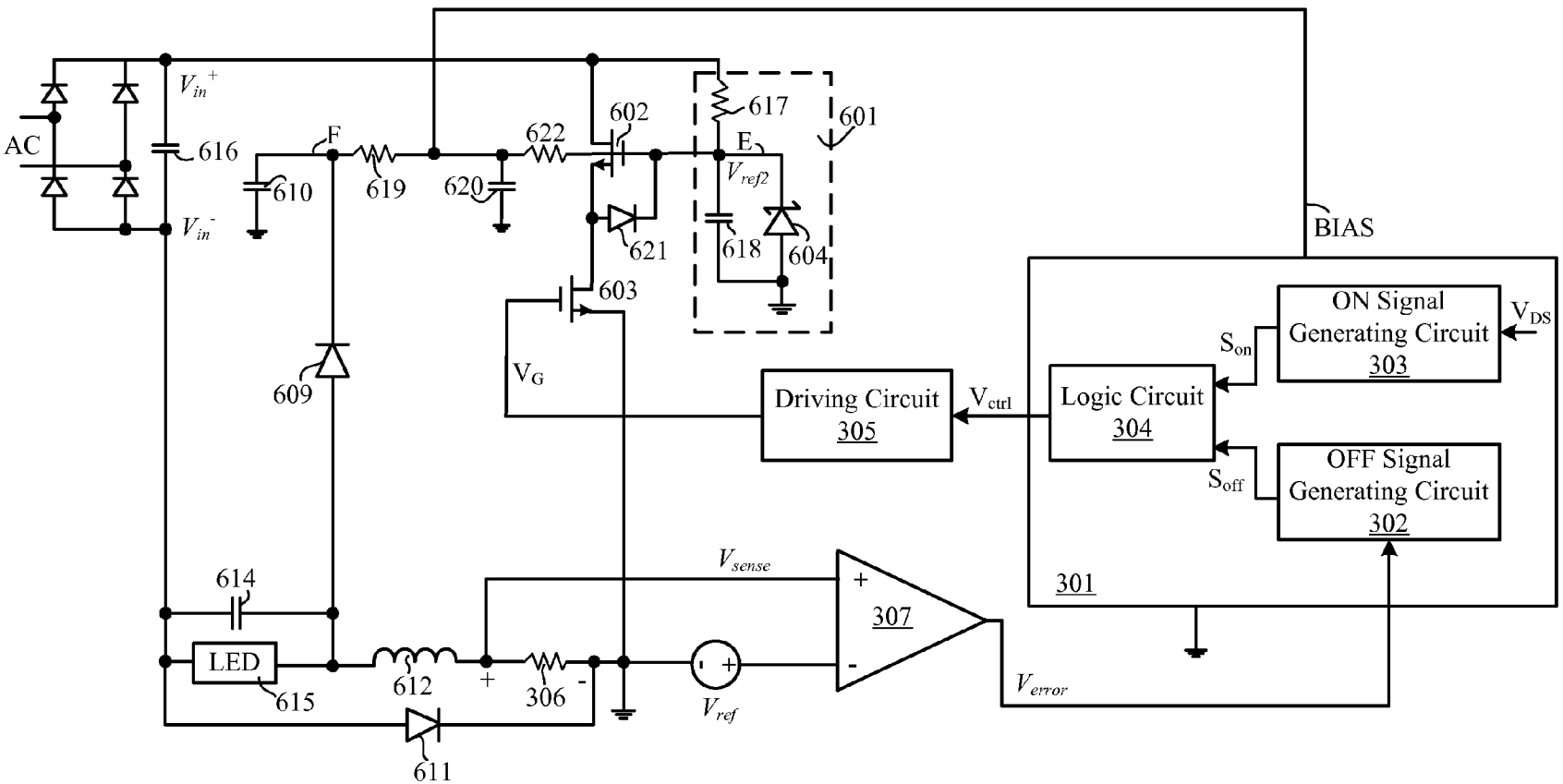
FIG. 6 shows a block diagram of an example control circuit of a LED driver in accordance with embodiments of the present invention.

For applications with relatively high input voltage, using a single power switch may be insufficient to meet high breakdown voltage requirements. Therefore, two series-connected power switches can be used to form a composite power switch. FIG. 6 shows a block diagram of an example LED driver with a composite power switch in accordance with embodiments of the present invention. In this example of a buck LED driver, the AC input power supply can be converted into a half sine wave DC input voltage $V_{in}$ through a bridge rectifier and filter capacitor 616, where half sine wave DC input voltage $V_{in}$ includes first input level $V_{in}^+$ and second input level $V_{in}^-$.

Series connected upper power switch 602 and lower power switch 603, output diode 611, output capacitor 614, and output inductor 612 can form a buck topology. For example, N-type MOSFETs can be utilized to implement power switches 602 and 603. Power switches 602 and 603, and start-up circuit 601, can form a composite high-voltage power switch. For example, the source of upper power switch 602 can connect to the drain of lower power switch 603, and the drain of upper power switch 602 can connect to first input level $V_{in}^+$, while the source of lower power switch 603 can connect to ground.

Start-up circuit 601 can include zener diode 604, resistor 617, and capacitor 618. For example, one end of resistor 617 can connect to first input level $V_{in}^+$, and the other end of resistor 617 can connect to one end of zener diode 604. The other end of zener diode 604 can connect to the source of lower power switch 603. The voltage at common connection node E can be regarded as reference voltage $V_{ref2}$, which can protect lower power switch 603 from bearing a relatively high voltage. The highest withstand voltage of upper power switch 602 can be reduced to be the difference between input power supply $V_{IN}$ and reference voltage $V_{ref2}$. Capacitor 618 and zener diode 604 can be connected in parallel to reduce the AC impedance of reference voltage $V_{ref2}$. By such a configuration, the withstand voltage of lower power switch 603 may not exceed reference voltage $V_{ref2}$, and the withstand voltage of upper power switch 602 can be reduced to the difference between input voltage peak $V_{INPK}$ and reference voltage $V_{ref2}$.

Output diode 611 can be connected between second input level $V_{in}^-$ and the source of lower power switch 603. Output inductor 612 and LED device 615 can be series-connected between second input level $V_{in}^-$ and the source of lower power switch 603, to reduce the AC current on LED device 615. Also, output capacitor 614 can be connected in parallel with LED device 615, to further reduce AC current on the LED device 615.

Detection resistor 306 of the LED current detection circuit can be series coupled to the output circuit formed by LED device 615 and output inductor 612 to precisely obtain current information $V_{sense}$ of LED device 615, and to obtain feedback signal $V_{error}$ through error amplifier 307 and reference voltage $V_{ref}$. Feedback signal $V_{error}$ can directly connect to a feedback input terminal of control circuit 301. Diode 621 can also connect between the drain of lower power switch 603 and common connection node E to absorb the leakage inductor spike and clamp.

When the system is powered on, capacitor 618 can be charged by half sine wave DC input voltage $V_{in}$ through resistor 617 and the output circuit (including output inductor 612, detection resistor 306, and LED device 615). When voltage at common connection node E gradually rises to reference voltage $V_{ref2}$ of zener diode 604, the system may be operable. At this time, drain-source voltage of lower power switch 603 can be clamped substantially to reference voltage $V_{ref2}$. The start-up current of control circuit 301 can be obtained from reference voltage $V_{ref2}$ at node E through resistor 622. When the voltage on capacitor 620 reaches a minimum start-up voltage, control circuit 301 may begin to operate to generate the control signal to turn on or off power switch 603, so as to generate a sufficient output current to drive LED device 615.

Diode 609 and filter capacitor 610 can be used to form a bias power supply circuit. For example, one end of diode 609 can connect to a common connection node of LED device 615 and output inductor 612, and the other end of diode 609 can connect to an end of filter capacitor 610 with a common connection node F. The other end of filter capacitor 610 can connect to ground. The voltage at common connection node F of diode 609 and filter capacitor 610 can be filtered by resistor 619 and capacitor 620 to operate as bias power supply BIAS for control circuit 301.

When lower power switch 603 is turned on, because the source of upper power switch 602 is coupled to ground through power switch 603, and the gate of power switch 602 can receive reference voltage $V_{ref2}$, upper power switch 602 can be turned on. When lower power switch 603 is turned off, upper power switch transistor 602 can also be turned off. Thus, upper power switch 602 and lower power switch 603 can be controlled according to control signal $V_{ctrl}$ output by control circuit 301.

With reference to the LED driver as shown in FIG. 6, the withstand voltage of the circuit can be enhanced by the composite power switch. Also, the upper power switch and the lower power switch can be different types of switching devices (e.g., NMOS transistors, PMOS transistors, LDMOS transistors, bipolar transistors, etc.). Also, the approach for the bias power supply as described herein are not limited to the illustrated configurations, but rather can be any suitable bias power supply methods or circuits. Although the above description has described different example buck LED drivers in accordance with embodiments of the present invention, people skilled in the art will recognize that the control circuit of the LED drivers can be set/reset with different peripheral circuits (e.g., power stage circuits, current detection circuits, etc.) to match buck drivers or boost-buck drivers.

Figure 7:
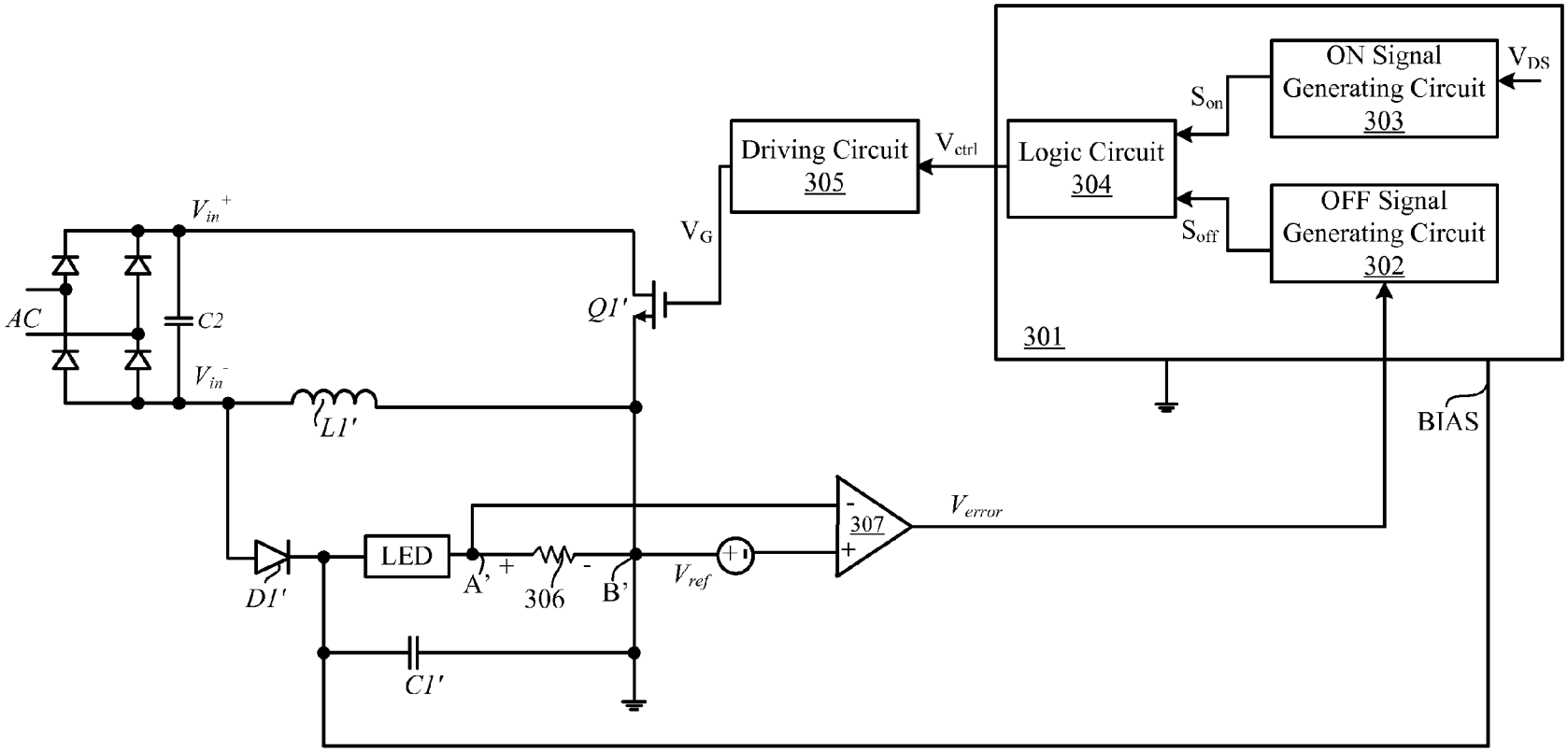
FIG. 7 shows a block diagram of an example boost-buck LED driver in accordance with embodiments of the present invention.

Referring now to FIG. 7, shown is a block diagram of an example boost-buck LED driver, in accordance with embodiments of the present invention. In this example, AC input power supply AC can be converted to half sine wave DC input voltage $V_{in}$ through the bridge rectifier and filter capacitor C2, where half sine wave DC input voltage $V_{in}$ has first input level of $V_{in}^{+}$ and second input level $V_{in}^{-}$.

Power switch Q1', output diode D1', output inductor L1', and output capacitor C1' can form a boost-buck topology power stage circuit. For example, an N-type power MOSFET can be used to implement power switch Q1'. The drain of power switch Q1' can connect to the first input level, and the source of power switch Q1' can connect to ground. Output inductor L1' can connect between the second input level and the source of power switch Q1'. Output diode D1' can connect between the LED device and the second input level. Output capacitor C1' can be parallel connected to the output circuit formed by the LED device and detection resistor 306.

Because resistor 306 is series-connected between the LED device and the source of power switch Q1', control circuit 301 can precisely obtain current information of the LED device. Power switch transistor Q1' can be implemented by any suitable type of switching devices (e.g., PMOS transistors, bipolar transistors, etc.), and output capacitor C1' can be connected to the output circuit in various different ways (e.g., via a parallel connection).

The bias power supply for control circuit 301 can be provided by the voltage on the common junction of output diode D1' and the LED device as shown. Of course, if the output voltage on LED device is too high, control circuit 301 may utilize a buck voltage regulator. If the output voltage on LED is too low, output inductor L1' may utilize an auxiliary winding to generate a bias power supply for control circuit 301.

For boost-buck LED drivers, as average input current $I_{in}$ may not have "dead" corners, the boost-buck LED driver can achieve an improved power factor. Further, as the influence on the power factor caused by the output voltage is relatively small, the boost-buck LED driver can be used in any combination of varied input and output voltages. As compared to the buck LED driver, since power switches and output diodes may suffer from the sum voltage of the input peak and output voltages, the boost-buck LED driver may utilize power transistors with higher withstand voltages when under the same input and output conditions.

Therefore, with the boost-buck LED driver shown in FIG. 7, not only may accurate detection of the LED current be achieved, but the circuit conversion accuracy can be improved, the power switch driver can be simplified, the product cost can be reduced, and driving losses can be reduced. Further, the output voltage of the LED device can be converted to the bias power supply of control circuit 301. Also, the boost-buck LED driver can achieve a relatively high power factor.

In summary, LED drivers in accordance with embodiments of the present invention can include or allow for power switches to be driven directly. Thus, the driving circuit for the power switches can be simplified and the power losses can be reduced. Also, because the supply power of the control circuit can be provided directly by the power stage circuit rather than via additional circuits, the circuit volume, product costs, and power losses due to such additional circuit structures can be reduced. In addition, the regulating accuracy of the driving current output by the LED driver can be improved by directly sampling the driving current information of the LED device. Further, a control mode for the drive circuit can substantially guarantee that the average input current can follow the input sine wave AC input power supply, thus achieving a relatively high power factor.

Various modifications and changes to the circuits and methods shown in the diagrams and discussed above can be made in accordance with embodiments. For example, other types of power MOSFETs (e.g., P-type MOSFETs, PNP transistors, NPN transistors, etc.) can replace N-type power MOSFETs. The above has described some example embodiments of the present invention, but practitioners with ordinary skill in the art will also recognize that other techniques or circuit structures can also be applied in accordance with embodiments of the present invention. The embodiments were chosen and described in order to best explain the principles of the invention and its practical applications, to thereby enable others skilled in the art to best utilize the invention and various embodiments with various modifications as are suited to the particular use contemplated. It is intended that the scope of the invention be defined by the claims appended hereto and their equivalents.

What is claimed is:

1. A light-emitting diode (LED) driver configured to drive an LED device, the LED driver comprising:

a) a rectifier bridge configured to receive an AC input voltage source, and to provide a first input voltage and a second input voltage;

b) an LED current detection circuit coupled to said LED device in series between said second input voltage and a ground, wherein said LED current detection circuit is configured to generate a feedback signal that represents an error between a driving current and an expected driving current of said LED device;

c) a power stage circuit having a power switch, wherein a first power switch terminal is coupled to said first input voltage, and a second power switch terminal is directly connected to said ground; and d) a control circuit coupled to said LED current detection circuit and said power stage circuit, wherein said control circuit shares said ground with said power stage circuit, and said control circuit is configured to generate a control signal according to said feedback signal and a drain-source voltage of said power switch, wherein said control signal is configured, in each switch period, to turn on said power switch when said drain-source voltage reaches a low level, and to turn off said power switch after a fixed time interval based on said feedback signal.

2. The LED driver of claim 1, wherein said power switch is turned off to maintain said driving current of said LED device as substantially constant, and to ensure that an average input current of said LED driver follows said AC input voltage source.

3. The LED driver of claim 1, wherein said control circuit comprises:

a) an ON signal generating circuit configured to detect said drain-source voltage, and to generate an ON signal when said drain-source voltage reaches said low level;

b) an OFF signal generating circuit configured to receive said feedback signal, and to generate an OFF signal after said fixed time interval; and c) a logic circuit coupled to said ON signal generating circuit and said OFF signal generating circuit, wherein said logic circuit is configured to generate said control signal according to said ON and OFF signals.

4. The LED driver of claim 3, wherein said OFF signal generating circuit is configured to compare said feedback signal and a ramp signal during an on time interval of said power switch, and to generate said OFF signal when said ramp signal reaches a level of said feedback signal.

5. The LED driver of claim 3, wherein said ON signal is configured to be generated when a predetermined delay time is detected after said drain-source voltage crosses zero.

6. The LED driver of claim 3, wherein said logic circuit comprises an RS flip-flop having set, reset, and output terminals, wherein said reset terminal is configured to receive said OFF signal, said set terminal is configured to receive said ON signal, and said output terminal is configured to provide said control signal.

7. The LED driver of claim 1, wherein said power stage circuit is configured for a buck topology.

8. The LED driver of claim 7, further comprising a bias power supply generating circuit having a diode and a capacitor, wherein said diode is coupled between a common node of an inductor of said power stage circuit and said LED device, and wherein a voltage at a common node of said diode and said capacitor is configured as a bias power supply of said control circuit.

9. The LED driver of claim 1, wherein said power stage circuit is configured for a boost-buck topology.

10. The LED driver of claim 9, wherein a voltage at a common node of an output diode of said power stage circuit and said LED device is configured as said bias power supply of said control circuit.

11. A light-emitting diode (LED) driver configured to drive an LED device, the LED driver comprising:

a) a rectifier bridge configured to receive an AC input voltage source, and to provide a first input voltage and a second input voltage;

b) an LED current detection circuit coupled to said LED device in series between said second input voltage and a ground, wherein said LED current detection is configured to generate a feedback signal that represents an error between a driving current and an expected driving current of said LED device;

c) a power stage circuit having a power switch, wherein a first power switch terminal is coupled to said first input voltage, and a second power switch terminal is directly connected to said ground;

d) a control circuit coupled to said LED current detection circuit and said power stage circuit, wherein said control circuit shares said ground with said power stage circuit, and said control circuit is configured to generate a control signal according to said feedback signal and a drain-source voltage of said power switch, wherein said control signal is configured, in each switch period, to turn on said power switch when said drain-source voltage reaches a low level, and to turn off said power switch after a fixed time interval based on said feedback signal; and e) wherein said power switch is a composite power switch formed by series connected first and second power switches, wherein a first power terminal of said first power switch is configured as a first power terminal of said composite power switch, a second power terminal of said second power switch is configured as a second power terminal of said composite power switch, a control terminal of said second power switch is configured as a control terminal of said composite power switch, and a voltage reference is configured between said control terminal of said first power switch and said second power terminal of said second power switch.

12. The LED driver of claim 11, wherein a voltage at a common node of an output diode of said power stage circuit and said LED device is configured as said bias power supply of said control circuit.

13. The LED driver of claim 11, wherein said power switch is turned off to maintain said driving current of said LED device as substantially constant, and to ensure that an average input current of said LED driver follows said AC input voltage source.

14. The LED driver of claim 11, wherein said control circuit comprises:

a) an ON signal generating circuit configured to detect said drain-source voltage, and to generate an ON signal when said drain-source voltage reaches said low level;

b) an OFF signal generating circuit configured to receive said feedback signal, and to generate an OFF signal after said fixed time interval; and c) a logic circuit coupled to said ON signal generating circuit and said OFF signal generating circuit, wherein said logic circuit is configured to generate said control signal according to said ON and OFF signals.

15. The LED driver of claim 14, wherein said OFF signal generating circuit is configured to compare said feedback signal and a ramp signal during an on time interval of said power switch, and to generate said OFF signal when said ramp signal reaches a level of said feedback signal.

16. The LED driver of claim 14, wherein said ON signal is configured to be generated when a predetermined delay time is detected after said drain-source voltage crosses zero.

17. The LED driver of claim 14, wherein said logic circuit comprises a RS flip-flop having set, reset, and output terminals, wherein said reset terminal is configured to receive said OFF signal, said set terminal is configured to receive said ON signal, and said output terminal is configured to provide said control signal.

* * * * *